US011348746B2

(12) United States Patent
Morrison et al.

(10) Patent No.: US 11,348,746 B2
(45) Date of Patent: May 31, 2022

(54) SCISSOR PLATE CONTROL SYSTEM AND METHOD FOR SLOWER MAGNETIC FORCE DECAY

(71) Applicant: Dell Products, LP, Round Rock, TX (US)

(72) Inventors: Jason S. Morrison, Chadron, NE (US); Laurent A. Regimbal, Georgetown, TX (US)

(73) Assignee: Dell Products, LP, Round Rock, TX (US)

( * ) Notice: Subject to any disclaimer, the term of this patent is extended or adjusted under 35 U.S.C. 154(b) by 463 days.

(21) Appl. No.: 16/405,894

(22) Filed: May 7, 2019

(65) Prior Publication Data

US 2020/0357584 A1 Nov. 12, 2020

(51) Int. Cl.

| | |
|---|---|
| ***H01H 36/00*** | (2006.01) |
| ***H01H 13/50*** | (2006.01) |
| ***H01H 13/20*** | (2006.01) |

(52) U.S. Cl.

CPC ..... *H01H 13/50* (2013.01); *H01H 13/20* (2013.01); *H01H 36/00* (2013.01); *H01H 36/0073* (2013.01); *H01H 2221/04* (2013.01); *H01H 2221/048* (2013.01)

(58) Field of Classification Search

CPC . H01H 36/00; H01H 36/0073; H01H 2221/04

See application file for complete search history.

(56) References Cited

U.S. PATENT DOCUMENTS

| | | | | |
|---|---|---|---|---|
| 10,957,501 | B1 * | 3/2021 | Brandt | G06F 1/1658 |
| 2018/0219553 | A1 * | 8/2018 | Casparian | G06F 3/0238 |

* cited by examiner

*Primary Examiner* — Ramon M Barrera

(74) *Attorney, Agent, or Firm* — Prol Intellectual Property Law, PLLC; H. Kenneth Prol

(57) ABSTRACT

An electro-permanent magnet key assembly may comprise an electro-permanent magnet generating a magnetic field when a direction of current applied to an electrically conductive wire coiled around a low-coercivity magnet, and a pair of scissor plates operably connected to the electropermanent magnet, such that the scissor plates rotate away from one another in the presence of downward force on a key cap situated atop the scissor plates. The top surface of the key cap may lie flush with adjacent keys of a keyboard when the key cap is in a neutral position. The electro-permanent magnet key assembly may further comprise a ferromagnetic flange operably connected to one of the scissor plates having angled overlap protrusions situated adjacent to the electropermanent magnet when the key cap is not in the neutral position, such that the angled overlap protrusions are attracted toward the magnetic field to return the key cap to the neutral position.

20 Claims, 8 Drawing Sheets

PERSPECTIVE VIEW

SCISSOR PLATE CONTROL SYSTEM AND METHOD FOR SLOWER MAGNETIC FORCE DECAY

FIELD OF THE DISCLOSURE

The present disclosure generally relates to a keyboard key switch assembly of information handling systems. The present disclosure more specifically relates to the use of electropermanent magnets in key switch assemblies.

BACKGROUND

As the value and use of information continues to increase, individuals and businesses seek additional ways to process and store information. One option available to clients is information handling systems. An information handling system generally processes, compiles, stores, and/or communicates information or data for business, personal, or other purposes thereby allowing clients to take advantage of the value of the information. Because technology and information handling needs and requirements vary between different clients or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific client or specific use, such as e-commerce, financial transaction processing, airline reservations, enterprise data storage, or global communications. In addition, information handling systems may include a variety of hardware and software components that may be configured to process, store, and communicate information and may include one or more computer systems, data storage systems, and networking systems. The information handling system may include telecommunication, network communication, and video communication capabilities. Further, the information handling system may include a keyboard for manual input of information by the user.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings may indicate similar or identical items.

DETAILED DESCRIPTION OF THE DRAWINGS

Figure 1:
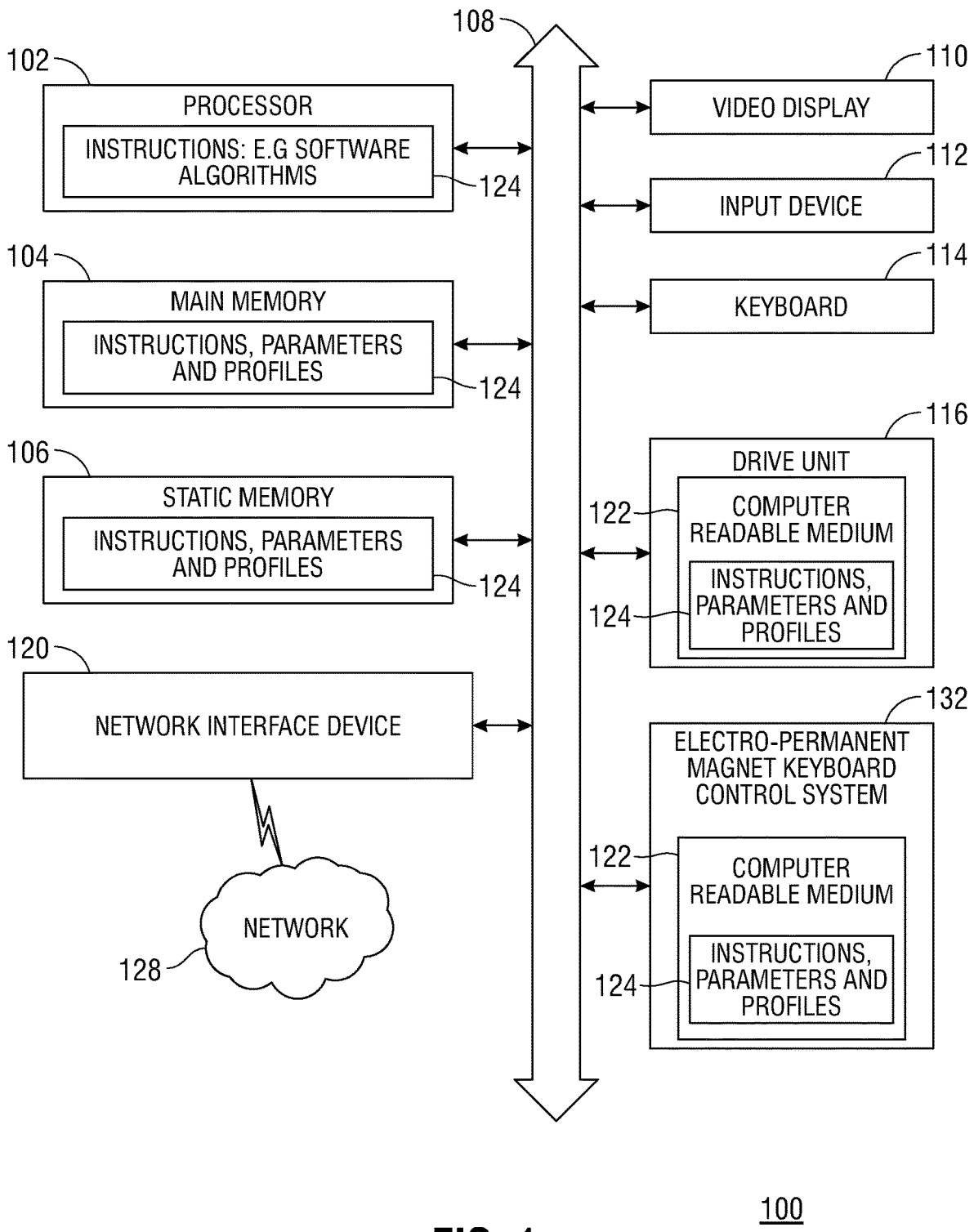
FIG. 1 is a block diagram illustrating an information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

In existing systems, each key on a laptop keyboard operates to depress a rubber dome/cup, or similar device, causing the information handling system to register that key has been pressed. Once the user removes pressure from the key, the rubber material of the dome/cup regains its original shape, forcing the key to rise back to the neutral position, flush with other keys on the keyboard. As such, keys on existing keyboards have only one default position in which the key cap is flush with the other keys of the keyboard. A system is needed in which the keys of a keyboard may have multiple default positions, including a position in which the key cap is below the plane formed by the key caps of the surrounding keys.

Embodiments of the present disclosure address this issue by applying a magnetic force, rather than the force supplied by a deformed rubber dome structure to return each key to its default or neutral position, flush with the other keys. Such a magnetic force may be varied such that an individual key cap may have a plurality of neutral positions. Moreover, with a magnetic key system, or maglev system, the same feel of a longer keystroke may be included in a thinner form factor by the magnetic resistance to the actuation of the key. Thus, a thinner and controllable key may be manufactured for keyboards and other systems.

A key assembly may include a key cap situated atop two scissor plates that may rotate outward from one another as a user applies downward force to the key cap (e.g., pressing the key). In the absence of rubber dome/cup assemblies, when the user removes such downward pressure, there is no force pushing the scissor plates back toward one another and the key cap back up toward the surface of the keyboard. In embodiments of the present disclosure, the outward rotation of the scissor plates caused by the user applying downward force on the key cap may simultaneously cause a flange susceptible to magnetic forces to rotate away from a magnet situated beneath the scissor plates. Once the user removes the downward force in such an embodiment, the magnet may exert a magnetic force to pull the flange operably connected to the scissor plates back toward the magnet. This may cause the scissor plates to rotate toward one another, pushing the key cap back to its neutral position, flush with the surface of the keyboard.

In addition to providing sufficient upward force to return the key back to its neutral position, use of such a magnetic key assembly in an embodiment may supply a consistent upward force the user must overcome in order to depress the key cap far enough for the information handling system to register its depression as a keystroke. This resistive force may feel to the user as if the key cap is travelling a deeper distance into the keyboard than it actually is.

Permanent magnets may be employed in magnetic keyboard assemblies in order to generate the upward force necessary to return the key cap to a neutral position and provide the user with the desired tactile sensation while depressing the key cap. However, magnetic fields generated by such permanent magnets cannot be adjusted, but rather, provide the same attractive force consistently. As such, the use of permanent magnets may not allow for a plurality of neutral positions.

Embodiments of the present disclosure employ electropermanent magnets in the key assembly in order to provide an adjustable upward force to return each key cap to its neutral position, and to allow each key to be placed in a plurality of neutral positions. Further, each keyboard key in embodiments of the present disclosure may include a separate electropermanent magnet, which may be controlled on an individual basis by an electropermanent magnet keyboard control system. Such embodiments allow the user to set an entire keyboard or even a single key within the keyboard to a specific resistive force chosen by the user to provide the optimal tactile sensation for that user. The magnetic field generated by such an electropermanent magnet in embodiments of the present disclosure may thus allow for more granular control of each key.

In order to ensure such a magnetic field is also sufficient to return the key cap to its neutral position, embodiments of the present disclosure add flanges to the magnetic element operably connected to the scissor plates that must be drawn toward the magnet to place the key cap back in its neutral position. These flanges may wrap around the external sides of the electropermanent magnet system at extensions of ferromagnetic shunts in embodiments, in order to increase the cross-sectional surface area in which the magnetic element operably connected to the scissor plates overlaps the field generated by the electropermanent magnet. As the overlapping surface area increases, so to does the force with which the electropermanent magnet draws the magnetic element operably connected to the scissor plates toward it. Using such an electropermanent magnet key assembly may provide an upward force to return each key cap to its neutral position, as well as a user-specified resistive force that may be adjusted on a key-by-key basis, without disrupting operation of any nearby internal components.

FIG. 1 illustrates an information handling system 100 similar to information handling systems according to several aspects of the present disclosure. In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, mobile device (e.g., personal digital assistant (PDA) or smart phone), server (e.g., blade server or rack server), a consumer electronic device, a network server or storage device, a network router, switch, or bridge, wireless router, or other network communication device, a network connected device (cellular telephone, tablet device, etc.), IoT computing device, wearable computing device, a set-top box (STB), a mobile information handling system, a palmtop computer, a laptop computer, a desktop computer, a communications device, an access point (AP), a base station transceiver, a wireless telephone, a land-line telephone, a control system, a camera, a scanner, a facsimile machine, a printer, a pager, a personal trusted device, a web appliance, or any other suitable machine capable of executing a set of instructions (sequential or otherwise) that specify actions to be taken by that machine, and can vary in size, shape, performance, price, and functionality.

In a networked deployment, the information handling system 100 may operate in the capacity of a server or as a client computer in a server-client network environment, or as a peer computer system in a peer-to-peer (or distributed) network environment. In a particular embodiment, the computer system 100 can be implemented using electronic devices that provide voice, video or data communication. For example, an information handling system 100 may be any mobile or other computing device capable of executing a set of instructions (sequential or otherwise) that specify actions to be taken by that machine. Further, while a single information handling system 100 is illustrated, the term "system" shall also be taken to include any collection of systems or sub-systems that individually or jointly execute a set, or multiple sets, of instructions to perform one or more computer functions.

The information handling system can include memory (volatile (e.g. random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. Portions of an information handling system may themselves be considered information handling systems.

Information handling system 100 can include devices or modules that embody one or more of the devices or execute instructions for the one or more systems and modules described above, and operates to perform one or more of the methods described above. The information handling system 100 may execute code instructions 124 that may operate on servers or systems, remote data centers, or on-box in individual client information handling systems according to various embodiments herein. In some embodiments, it is understood any or all portions of code instructions 124 may operate on a plurality of information handling systems 100.

The information handling system 100 may include a processor 102 such as a central processing unit (CPU), control logic or some combination of the same. Any of the processing resources may operate to execute code that is either firmware or software code. Moreover, the information handling system 100 can include memory such as main memory 104, static memory 106, computer readable medium 122 storing instructions 124 of the electropermanent magnet keyboard control system 132, and drive unit 116 (volatile (e.g. random-access memory, etc.), nonvolatile (read-only memory, flash memory etc.) or any combination thereof). The information handling system 100 can also include one or more buses 108 operable to transmit communications between the various hardware components such as any combination of various input and output (I/O) devices.

As shown, the information handling system 100 may further include a video display 110. The video display 110 in an embodiment may function as a liquid crystal display (LCD), an organic light emitting diode (OLED), a flat panel display, a solid state display, or a cathode ray tube (CRT). Additionally, the information handling system 100 may include an input device 112, such as a cursor control device (e.g., mouse, touchpad, or gesture or touch screen input, and a keyboard 114. The information handling system 100 can also include a disk drive unit 116.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. In some aspects of the present disclosure, one wireless adapter 120 may operate two or more wireless links. The wireless network may have a wireless mesh architecture in accordance with mesh networks described by the wireless data communications standards or similar standards in some embodiments but not necessarily in all embodiments.

Wireless adapter 120 may connect to any combination of macro-cellular wireless connections including 2G, 2.5G, 3G, 4G, 5G or the like from one or more service providers. Utilization of radiofrequency communication bands according to several example embodiments of the present disclosure may include bands used with the WLAN standards and WWAN carriers, which may operate in both license and unlicensed spectrums. For example, both WLAN and WWAN may use the Unlicensed National Information Infrastructure (U-NII) band which typically operates in the ~5 MHz frequency band such as 802.11 a/h/j/n/ac (e.g., center frequencies between 5.170-5.785 GHz). It is understood that any number of available channels may be available under the 5 GHz shared communication frequency band. WLAN, for example, may also operate at a 2.4 GHz band. WWAN may operate in a number of bands, some of which are proprietary but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. In the example embodiment, mobile information handling system 100 includes both unlicensed wireless radio frequency communication capabilities as well as licensed wireless radio frequency communication capabilities. For example, licensed wireless radio frequency communication capabilities may be available via a subscriber carrier wireless service.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionality as described herein.

The present disclosure contemplates a computer-readable medium that includes instructions, parameters, and profiles 124 or receives and executes instructions, parameters, and profiles 124 responsive to a propagated signal, so that a device connected to a network 128 can communicate voice, video or data over the network 128. Further, the instructions 124 may be transmitted or received over the network 128 via the network interface device or wireless adapter 120.

The information handling system 100 can include a set of instructions 124 that can be executed to cause the computer system to perform any one or more of the methods or computer based functions disclosed herein. For example, instructions 124 may execute a electropermanent magnet keyboard control system 132, software agents, or other aspects or components. Various software modules comprising application instructions 124 may be coordinated by an operating system (OS), and/or via an application programming interface (API). An example operating system may include Windows®, Android®, and other OS types known in the art. Example APIs may include Win 32, Core Java API, or Android APIs.

The disk drive unit 116 and the electropermanent magnet keyboard control system 132 may include a computer-readable medium 122 in which one or more sets of instructions 124 such as software can be embedded. Similarly, main memory 104 and static memory 106 may also contain a computer-readable medium for storage of one or more sets of instructions, parameters, or profiles 124 including an estimated training duration table. The disk drive unit 116 and static memory 106 also contain space for data storage. Further, the instructions 124 may embody one or more of the methods or logic as described herein. For example, instructions relating to the electropermanent magnet keyboard control system 132 software algorithms may be stored here. In a particular embodiment, the instructions, parameters, and profiles 124 may reside completely, or at least partially, within the main memory 104, the static memory 106, and/or within the disk drive 116 during execution by the processor 102 of information handling system 100. As explained, some or all of the electropermanent magnet keyboard control system 132 may be executed locally or remotely. The main memory 104 and the processor 102 also may include computer-readable media.

Main memory 104 may contain computer-readable medium (not shown), such as RAM in an example embodiment. An example of main memory 104 includes random access memory (RAM) such as static RAM (SRAM), dynamic RAM (DRAM), non-volatile RAM (NV-RAM), or the like, read only memory (ROM), another type of memory, or a combination thereof. Static memory 106 may contain computer-readable medium (not shown), such as NOR or NAND flash memory in some example embodiments. The electropermanent magnet keyboard control system 132 may be stored in static memory 106, or the drive unit 116 on a computer-readable medium 122 such as a flash memory or magnetic disk in an example embodiment. While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

The information handling system 100 may also include a electropermanent magnet keyboard control system 132 that may be operably connected to the bus 108. The electropermanent magnet keyboard control system 132 computer readable medium 122 may also contain space for data storage. The electropermanent magnet keyboard control system 132 may perform tasks related to controlling activation of the electropermanent magnet in some embodiments. In other embodiments, the electropermanent magnet keyboard control system 132 may perform tasks related to controlling the magnitude of the magnetic field generated by an electropermanent magnet within a key switch assembly. In some embodiments, a current applied to one or more coils of a plurality of low-coercivity magnets may correspond to a user-selected magnitude when a stepped electro-permanent magnet system is used.

In an embodiment, the electropermanent magnet keyboard control system 132 may communicate with the main memory 104, the processor 102, the video display 110, the alpha-numeric input device 112, and the network interface device 120 via bus 108, and several forms of communication may be used, including ACPI, SMBus, a 24 MHZ BFSK-coded transmission channel, or shared memory. Keyboard driver software, firmware, controllers and the like may communicate with applications on the information handling system.

In other embodiments, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

When referred to as a "system", a "device," a "module," a "controller," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device). The system, device, controller, or module can include software, including firmware embedded at a device, such as an Intel® Core class processor, ARM® brand processors, Qualcomm® Snapdragon processors, or other processors and chipsets, or other such device, or software capable of operating a relevant environment of the information handling system. The system, device, controller, or module can also include a combination of the foregoing examples of hardware or software. Note that an information handling system can include an integrated circuit or a board-level product having portions thereof that can also be any combination of hardware and software. Devices, modules, resources, controllers, or programs that are in communication with one another need not be in continuous communication with each other, unless expressly specified otherwise. In addition, devices, modules, resources, controllers, or programs that are in communication with one another can communicate directly or indirectly through one or more intermediaries.

Figure 2:
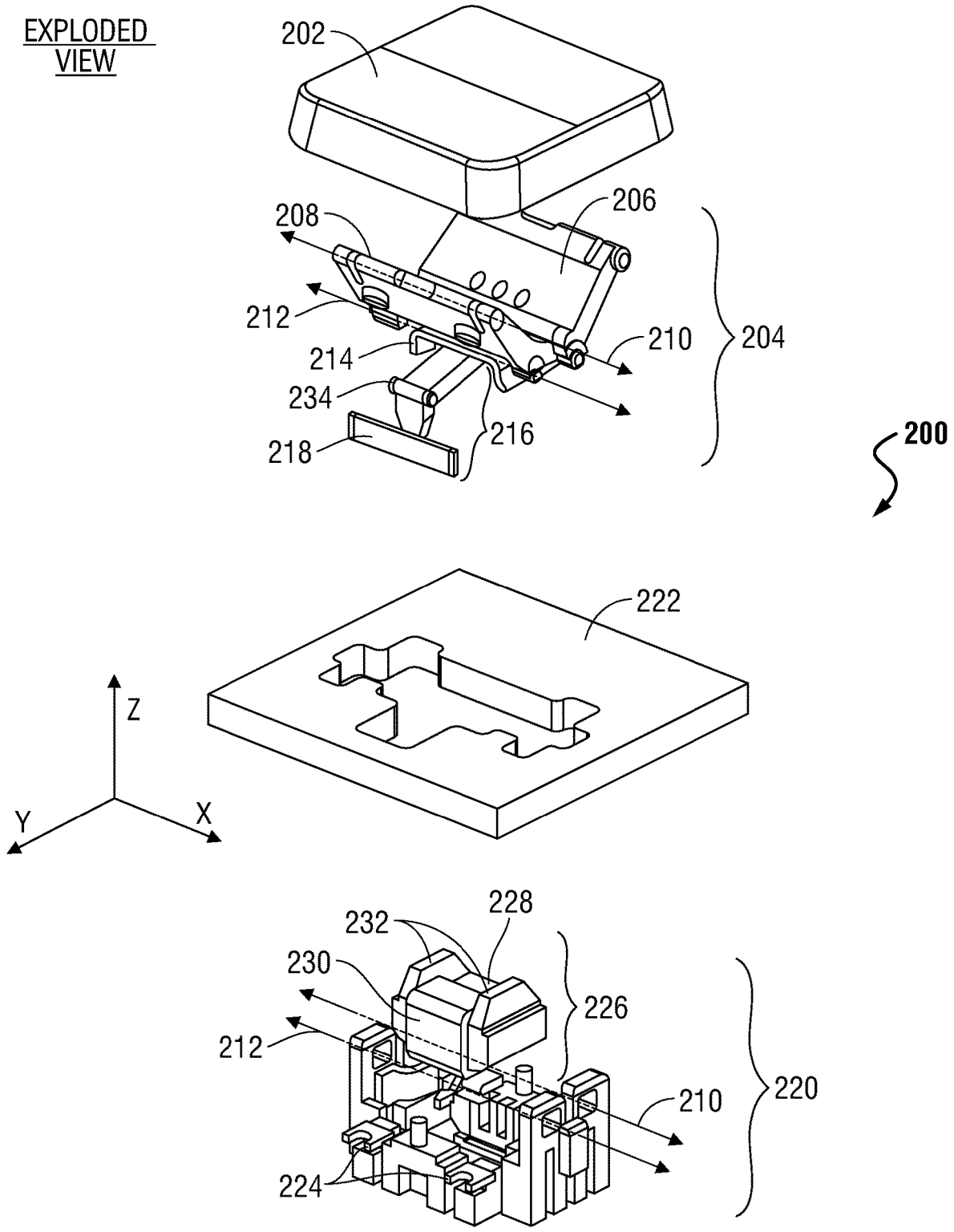
FIG. 2 is an exploded, perspective graphical diagram view of a key switch assembly with an electropermanent magnet (EPM) and a scissor plate flange according to an embodiment of the present disclosure.

FIG. 2 is an exploded, perspective graphical diagram view of a key switch assembly with an electropermanent magnet (EPM) and a scissor plate flange shaped for increased magnetic attraction between the flange and the EPM according to an embodiment of the present disclosure. A key switch assembly 200 in an embodiment may enable an information handling system to register a keystroke entered by a user via a keyboard. Each key within such a keyboard may be incorporated within a key switch assembly 200, and may comprise a key cap 202 lying atop a scissor plate assembly 204 in an embodiment.

The scissor plate assembly 204 in an embodiment may include a rear scissor plate 206 and a front scissor plate 208, the top portions of which (e.g., portions located furthest from a rotation axis) may rotate away from one another when a sufficient downward force is exerted on the key cap 202. Such a rotation in an embodiment may cause either a portion of the scissor plates 206 and 208 themselves, or a mechanism operably attached to the scissor plates 206 and 208 to come into contact with a sensor to indicate the key has been depressed. In such a way, the rotation of the scissor plates 206 and 208 may be actuated while the information handling system registers occurrence of a keystroke.

The scissor plates 206 and 208 in an embodiment may be operably connected to a base contact assembly 220 immovably fixed to the keyboard of the information handling system during operations of the key assembly 200. In other words, depression of the key cap 202 in an embodiment may not cause any vertical movement of the base contact assembly 220 during actuation. Each of the scissor plates 206 and 208 may be connected to the base contact assembly 220 such that the rotation axis for each of the scissor plates transects a cross-sectional area shared by the scissor plates 206 and 208 and the base contact assembly 220. For example, in an embodiment, the scissor plates 206 and 208 may be inserted through a cap support plate 222 to join with the base contact assembly 220. The cap support plate 222 in such an embodiment may be a surface onto which the base contact assembly 220 is soldered, and may provide a limit to which the key cap 202 may travel downward. In some embodiments, the cap support plate 222 may be a printed circuit board (PCB), and in other embodiments, the cap support plate 222 may include a metallic plate for additional structure. The cap support plate 222 may include a pressure contact switch (not depicted) located on the cap support plate under scissor plate 206, 208, or both in some embodiments. The nodules located on the underside of scissor plate 206 or 208 (shown) may make contact with the pressure contact switch of PCB board of the cap support plate 222 to register a keystroke of the key. Other embodiments of key switch contact to record a keystroke are also contemplated in various embodiments including other embodiments described herein. For example, rocker arm 216 may cause leaf spring scissor plate switch contact 218 to contact the base switch contact 224 in another switch contact embodiment.

The scissor plates 206 and 208 may reach a maximum allowable angle of separation or rotation about their respective axes 210 and 212 when the cap support plate 222 obstructs further downward vertical movement of the key cap 202 in an embodiment. In such an embodiment, a pin or similar mechanism may join the scissor plates 206 and 208 to one or more holes within the base contact assembly 220 to form one or more hinges. In the example embodiment illustrated by FIG. 2, the rear scissor plate 206 may be joined with the base contact assembly 220 in such a way to form a hinge allowing the rear scissor plate 206 to rotate about the rear plate rotation axis 210 that transects a cross-sectional area (e.g., in the YZ plane) shared by both the rear scissor plate 206 and the base contact assembly 220. Similarly, the front scissor plate 208 may be joined with the base contact assembly 220 to allow the front scissor plate 208 to rotate about the front plate rotation axis 212 transecting a cross-sectional area (e.g., in the YZ plane) shared by both the front scissor plate 206 and the base contact assembly 220. In other embodiments, the front scissor plate 208 and rear scissor plate 206 may share a single rotational axis.

As described herein, the rotation of the scissor plates 206 and 208 may actuate while the information handling system registers occurrence of a keystroke during a depression of key cap 202 by a user. As a downward force is exerted on the key cap 202, the top portions of the rear scissor plate 206 and front scissor plate 208 may move away from one another in the Y-direction. In previous keyboard systems, such a separation may expose the key cap to the top portion of a rubber dome structure housed within the scissor plate assembly 204, such that the key cap would cause the dome structure to deform. Upon such a deformation in previous systems, a portion of the dome structure itself, or a secondary structure within the dome structure would be pushed downward, below the rotation axes 210 and 212 to contact a sensor element. Such a sensor element may be located in such prior systems, for example, on the surface of the cap support plate 222, or within the base contact assembly 220. The information handling system in such previous systems may then register the contact between the sensor and the dome structure (or its internal secondary structure) as a keystroke. When the downward force used to deform the rubber dome structure is removed in such previous systems, the rubber dome structure would automatically return to its undeformed or neutral dimensions, causing the key cap to return to its neutral position, having a top surface flush with the other keys in the keyboard. Rubber dome structures of these previous systems do not allow for a plurality of neutral positions, nor an adjustable upward force the user must overcome to depress the keys.

Embodiments of the present disclosure may use methods to register keystrokes that do not require such rubber dome structures. For example, a keystroke in an embodiment described herein may be registered upon detected contact between one of the scissor plates 206 or 208 and a sensor. Such a sensor may be situated, in one example, on the top surface of the cap support plate 222 as described, such that the bottom portion of one or both of the scissor plates 206 or 208 comes into contact with the sensor when the key cap 202 reaches its lowest allowable vertical position. The sensor may be, for example, a pressure sensor sensing the downward pressure from the scissor plate(s) 206 or 208, or in another example, an electrical contact that completes a circuit when it comes into contact with a corresponding metal contact located on the bottom portion of the one or more scissor plates 206 and 208.

In other embodiments, a portion of the scissor plates 206 and 208, or a structure extending from or operably attached to the scissor plates 206 and 208 may initiate contact with a sensor within the base contact assembly 220. For example, a scissor plate switch contact 218 is a leaf spring in an embodiment and may be operably connected to a rocker arm 216 and connected to the cap support plate 222 via a hinge 234 about which the rocker arm 216 may rotate. Upon final construction of the whole key switch assembly 200 in an embodiment, the rocker arm 216 may extend outward in the Y-direction, such that the ends of the scissor plate switch contact 218 are aligned with the base switch contact 224. While in the neutral position, the magnetic field of the EPM 226 may pull the scissor plate EPM flange 214 downward toward the EPM 226, causing the bottom surface of the flange 214 to come into contact with the top surface of the portion of the rocker arm 216 closest to the flange 214. This contact may cause the rocker arm 216 to rotate about its hinge 234, such that the scissor plate switch contact 218 leaf spring is pushed out in the Y-direction away from the base switch contact 224.

When the key cap 202 is forced down to its depressed position in such an embodiment, the rotation of the upper portions of scissor plates 206 and 208 away from one another (in the Y-direction) may cause the scissor plate EPM flange 214 to rotate upward such that it releases the rocker arm 216, allowing the rocker arm to rotate such that the scissor plate switch contact 218 leaf spring relaxes inward and the ends contact the base switch contact 224. This contact may close a circuit, which the information handling system in an embodiment may register as a key stroke.

As described herein, embodiments of the present disclosure may replace the rubber dome structures capable of only one neutral position and one upward force with a key switch assembly capable of a plurality of neutral positions and a plurality of upward forces the user must overcome to register a keystroke. Moreover, it is an improvement on other magnetic keyboard systems. For example, the key switch assembly 200 in an embodiment may include an electropermanent magnet (EPM) housed within the base contact assembly 220 in an example embodiment. An electro-permanent magnet, such as EPM 226 may include one or more high-coercivity magnets 228 situated nearby one or more low-coercivity magnets 230. The low-coercivity magnets 230 in an embodiment may be comprised of a combination of aluminum, nickel, and cobalt, for example AlNiCo. Such low-coercivity magnets may be subject to polarity changes when a current is applied across a coil wrapped around the low-coercivity magnet 230 (shown encased in FIG. 2). Other embodiments contemplate the use of other materials, or other combinations that include these materials or others, including iron, and nitrogen. The high-coercivity magnets 228 in an embodiment may be comprised of a combination of Neodymium, Iron, and Boron. Other embodiments contemplate the use of any of these materials individually, of other materials, or of other combinations that include these materials or others generally used to create permanent magnets, including ferrous platinum, a combination of dysprosium, niobium, gallium and cobalt, and samarium-cobalt.

An electrically conductive wire (e.g., copper wire) may be coiled around the low-coercivity magnets 230 in an embodiment. The EPM keyboard control system in an embodiment may apply a pulse of current in a first direction through the electrically conductive wires coiled around one or more of the low-coercivity magnet 230, causing a switch in polarity such that the poles of the low-coercivity magnets 230 line up with the poles of the high-coercivity magnets 228. In such an embodiment, the magnetic fields of the high-coercivity magnets 228 and low-coercivity magnets 230 may compound to generate a magnetic field having an intensity greater than that of either the high-coercivity magnetic field or the low-coercivity magnetic field alone. Such a combined magnetic field may also be propagated by one or more magnetically soft shunts 232 comprised of steel or iron within the base contact assembly 220. The compound magnetic force generated by both the high-coercivity magnets 228 and the low-coercivity magnets 230 in such an embodiment may maintain this magnitude until another current pulse is applied to the electrically conductive wire. Thus, embodiments of the present disclosure capitalize on the advantage of electro-permanent magnets to maintain a constant magnetic field intensity with only a pulse of current. In contrast, electro-magnets require ongoing application of voltage to one or more magnetic components, thus depleting energy resources more quickly.

In another aspect of an embodiment, the EPM keyboard control system may apply a current in a second direction, opposite the first direction, causing the polarity of the magnetic field generated by the low-coercivity magnet 230 to reverse. In such an embodiment, the poles of the magnetic field generated by the high-coercivity magnets 228 may lie opposite the poles of the magnetic field generated by the low-coercivity magnets 230. The magnetic field of the high-coercivity magnet 228 may thus negate the magnetic field of the low-coercivity magnets 230, disabling the EPM 226 such that the total magnetic force of the EPM 226 is zero or of a very low magnitude. Upon application of a reverse current pulse, the polarity of the low-coercivity magnet or magnets 230 reverses and neutralizes the high-coercivity magnet 228 effectively turning off or turning down the electropermanent magnet 226.

Embodiments of the present disclosure may employ a single EPM 226, including only one high-coercivity magnet 228 and one low-coercivity magnet 230. Such a single EPM system may be capable of achieving two separate states. First, the single EPM system may achieve an on state, in which the EPM 226 generates a combined magnetic field from the high-coercivity magnet and the low-coercivity magnet. Second, the single EPM system may achieve an off state, in which the magnetic field generated by the high-coercivity magnet negates the magnetic field generated by the low-coercivity magnet.

In another embodiment, a multi-level-EPM may include one or more high-coercivity magnets 228 and two or more low-coercivity magnets 230. Each of the low-coercivity magnets 230 in such an embodiment may be capable of receiving a current burst independent of the other. Combinations of the polarity alignments of the low-coercivity magnets 230 relative to the one or more high-coercivity magnets 228 may yield a variety of magnetic levels. For example, the EPM keyboard control system in such an embodiment may apply a first current to a first low-coercivity magnet, causing the magnetic field of the first low-coercivity magnet to partially combine with the magnetic field of a first high-coercivity magnet. Simultaneously, the EPM keyboard control system in such an embodiment may apply a second current to a second low-coercivity magnet, causing the magnetic field of the second low-coercivity magnet to partially negate the magnetic field of the high-coercivity magnet for one magnetic level or a reverse second current may cause the second low-coercivity magnet to partially combine with the high-coercivity magnet for a third magnetic level. In such a way, the EPM keyboard control system in an embodiment may be capable of placing a multilevel-EPM 226 in one of three different states. Combinations of low-coercivity magnets and high-coercivity magnets may be used to provide multiple, adjustable magnetic levels in some embodiments. Further gradation in overall magnetic field strength for the EPM 226 may be achieved in other embodiments by including more than two EPMs within the key assembly 200, or by applying multiple current pulses of increasing amplitude to a single low-coercivity magnet (to increase its magnetic field strength in a step-wise fashion). The EPM keyboard control system in an embodiment may thus adjust the magnitude of the total magnetic field generated by the EPM 226 by controlling the direction of current applied to one or more electrically conductive wires coiled around one or more low-coercivity magnets 230.

The EPM 226 in an embodiment may cause the key cap 202 to return to its neutral position following depression by forcing the scissor plates toward one another. In an embodiment, such a force may be generated by magnetically attracting a structure operably connected to one or more of the scissor plates down toward the EPM 226. For example, the EPM 226 in an embodiment may generate a magnetic field that attracts a scissor plate EPM flange 214 susceptible to magnetic forces down toward the EPM 226. The flange 214 in an embodiment may be comprised of a ferromagnetic material, such as steel. In such an embodiment, the scissor plate EPM flange 214 may be operably connected to the rear scissor plate 206, and may extend from the base of the rear scissor plate, beyond the rear scissor plate rotation axis 210 in the positive Y direction. When operably connected in such a configuration, any rotation of the scissor plate EPM flange 214 about the rear plate rotation axis 210 may cause a rotation of the rear scissor plate 206 in the same direction about the rear plate rotation axis 210. For example, a rotation of the EPM flange 214 about the rear plate rotation axis 210 that is counter-clockwise in the YZ plane may cause a counter-clockwise rotation of the top of the rear scissor plate 206 about the rear plate rotation axis 210. This counter-clockwise rotation may occur, for example, when the scissor plate EPM flange 214, or a portion thereof is drawn downward toward the EPM 226. Thus, the attraction of the flange 214 toward the EPM 226 may cause the top portion of the rear scissor plate 206 to rotate toward the top portion of the front scissor plate 208, forcing the key cap 202 upward.

The upward force on the key cap 202 caused by the magnetic attraction between the flange 214 and the EPM 226 in an embodiment may also control the force with which a user must press down on the key cap 202 in order for the information handling system to register a keystroke. The magnetic field may be generated by the EPM 226 in an embodiment throughout the vertical movement of the key cap 202 in an embodiment. Thus, a force great enough to overcome the magnetic attraction between the flange 214 and the EPM 226 must be applied to the key cap 202 in order for the contact element within or operably connected to the scissor plate assembly 204 to come into contact with the contact element or other sensor within either the cap support plate 222 or the base contact assembly 220. As described herein, such a contact may be needed in order to register a keystroke. By controlling the direction of current delivered to an electrically conductive wire coiled around one or more low-coercivity magnets 230 in such an embodiment, the EPM keyboard control system may also control the degree of force required to register a keystroke.

Because each key assembly 200 may include an individually controllable EPM 226 in an embodiment, the EPM keyboard control system may adjust the force needed to depress the key cap on a key-by-key basis, such that some keys require more force than others. In other embodiments, by disabling the EPM 226 completely, the EPM keyboard control system may ensure the key cap 202 does not return to its neutral position, thus disallowing the user to enter a keystroke with that key. This may be useful, for example, when the information handling system is a laptop placed in a closed configuration in which the keyboard is placed nearby or in close contact with the display screen. In such an embodiment, the EPM keyboard control system may detect that the laptop has been placed in the closed configuration, and disable the EPMs for all of the keys in the keyboard to draw the key caps away from the display screen such that they do not cause frictional wear and tear on the display. In another aspect, this retractability may be useful in a gaming scenario in which the key being actuated represents an action currently unavailable to the user (e.g., firing of an unavailable weapon in a first-person-shooter computer game).

Further, the EPM keyboard control system in an embodiment may set the force needed to depress one of more keys according to external stimuli. For example, the information handling system in an embodiment may detect (e.g., via rotation sensors, hall sensors, proximity sensing elements, gyroscopes, etc.) that the information handling system has been placed in a closed or tablet configuration in which the keyboard is not likely to be used. In such an embodiment, the EPM keyboard control system may reverse direction of current to the low-coercivity magnets 230 of one or more key switch assemblies 200, for example to put keys in a depressed position, such that the keys cannot be actuated. In such a way, the user may continue to use the information handling system in tablet mode without the risk of erroneous keystrokes. Similarly, by placing the keys in a locked depressed position when the information handling system is in a closed configuration, the EPM keyboard control system in an embodiment may remove the risk of key caps damaging the digital display through unintentional contact between the two.

As another example, the EPM keyboard control system may set the force needed according to a received user input. This may allow each individual user to set the force required to press keys on the keyboard to a level that is tactilely pleasing to the user. This facet of the EPM keyboard control system may also provide the user with a sensation that the keys are travelling a longer vertical distance (e.g. deeper into the keyboard) than they actually are, ensuring the decreased thickness of the keyboard does not negatively impact user experience. In these ways, the EPM keyboard control system in an embodiment may cause the key switch assembly 200 to provide an upward force to return each key cap to its neutral position, cause the key switch assembly 200 to remain in a fixed depressed position that disallows the user to register a keystroke, and/or apply a user-specified (or externally triggered) resistive force that may be adjusted on a key by key basis.

Figure 3A:
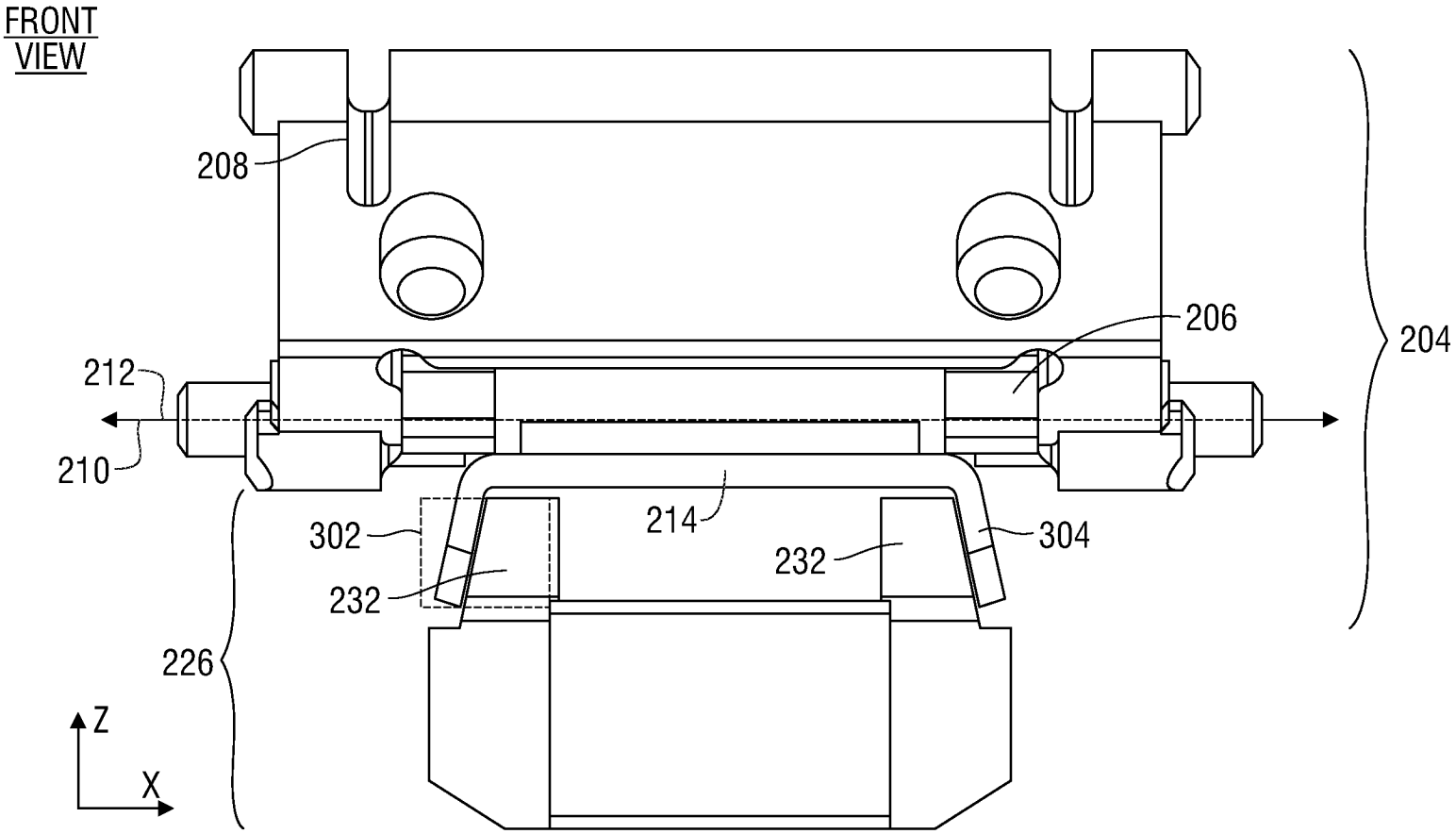
FIG. 3A is a front graphical diagram view of an EPM and a scissor plate assembly in a neutral position according to an embodiment of the present disclosure.

FIG. 3A is a front graphical diagram view of an electropermanent magnet (EPM) and a scissor plate assembly in a neutral position with and a scissor plate flange shaped for increased magnetic attraction between the flange and the EPM according to an embodiment of the present disclosure. The configuration shown in FIG. 3A reflects the orientation the scissor plate assembly 204 and the EPM 226 may have with respect to one another in an embodiment upon assembly of the full key switch assembly. The key cap, and support plate portions of the key switch assembly are not shown in FIG. 3A, nor are the other portions of the scissor plate assembly 204 or the portions of the base contact assembly 220 other than the EPM 226. These structures are absent in FIGS. 3A-4B to give an non-obscured view of the proximity between the scissor plate assembly 204 and the EPM 226 in an embodiment.

As described herein, the key assembly is in a neutral state when no downward force is being exerted on the key cap. In such a state, neither the front scissor plate 208 nor the rear scissor plate 206 are rotated away from one another about their respective axes 210 and 212 in an embodiment. The rear scissor plate 206 may be operably and fixedly attached to the scissor plate EPM flange 214 at the rotating edge of the rear scissor plate 206 in an embodiment, such that the scissor plate EPM flange 214 rotates when the rear scissor plate 206 rotates. In an embodiment, when the edge of the rear scissor plate 206 located opposite the rear plate rotation axis 210 moves downward with respect to the rear plate rotation axis 210, the edge of the scissor plate EPM flange 214 located furthest from the rear plate rotation axis 210 may move upward. Similarly, when the edge of the rear scissor plate 206 located opposite the rear plate rotation axis 210 moves upward with respect to the rear plate rotation axis 210, the scissor plate EPM flange 214 located furthest from the rear plate rotation axis 210 may move downward.

The scissor plate EPM flange 214 may include one or more angular overlap protrusions 304 from the portion of the scissor plate EPM flange 214 that are oriented roughly horizontally when the scissor plate EPM flange 214 is in its neutral position. Each of these angled overlap protrusions 304 in an embodiment may be placed in close proximity to and rotate about the outer surfaces of each of the magnetically soft shunts 232 propagating the combined magnetic field of the EPM 226. The placement of these angled overlap protrusions 304 of the scissor plate EPM flange 214 adjacent to the exterior surfaces of the magnetically soft shunts 232 may cause a region 302 in which a portion of the surface area of each angled overlap protrusions 304 of the scissor plate EPM flange 214 overlaps (in the YZ plane) a portion of a magnetically soft shunt 232 exterior surface area. The angled overlap protrusions 304 may be at a ninety-degree angle or vertical to a horizontal scissor plate EPM flange, or may be at any angle to provide additional overlapping surface area 302. By angling the protrusions 304 toward the EPM 226 in such an embodiment, the effect the EPM 226 magnetic field has on the flange 214, including the angled overlapping protrusions 304, may be increased.

Figure 3B:
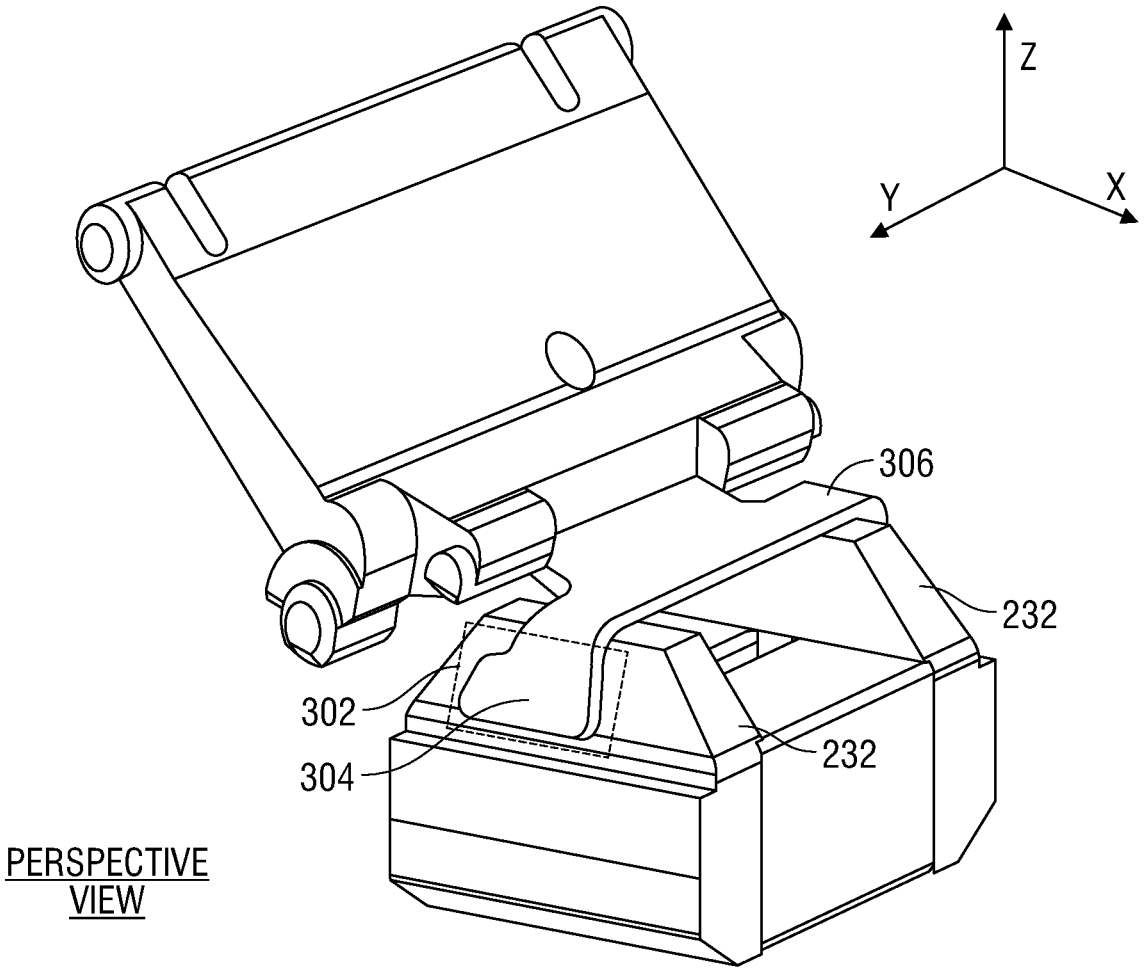
FIG. 3B is a perspective graphical diagram view of an EPM and a scissor plate assembly in a neutral position according to an embodiment of the present disclosure.

FIG. 3B is a perspective graphical diagram view of an electropermanent magnet (EPM) and a scissor plate assembly in a neutral position with and a scissor plate flange shaped for increased magnetic attraction between the flange and the EPM according to an embodiment of the present disclosure. As described herein, the scissor plate EPM flange 214 may include one or more angled overlap protrusions 304 from the portion of the scissor plate EPM flange 214, which may be oriented roughly horizontally when the scissor plate EPM flange 214 is in its neutral position. For example, the scissor plate EPM flange 214 may include angular overlap protrusions 304, protruding at an angle from the neutrally horizontal flange portion 306. When the scissor plate EPM flange 214 is in its neutral position, the neutrally horizontal flange portion 306 may be oriented roughly horizontally (e.g. within the X-Z plane).

The surface area of the angular overlap protrusions 304 in such an embodiment is in closer proximity to the magnetically soft shunts 232 and may be markedly greater than the surface area of such neutrally horizontal flange portion 306 in close proximity to the magnetically soft shunts 232. For example, only the surface area of the neutrally horizontal flange portion 306 located directly above the magnetically soft shunts 232 in an embodiment may be within a given proximity to the magnetically soft shunts 232. In contrast, with the angular overlap protrusions 304 in an embodiment, almost the entire interior surface area of the angular overlap protrusion 304 in such an embodiment (as illustrated by the region 302) may also be within that given proximity to the magnetically soft shunts 232.

Figure 4A:
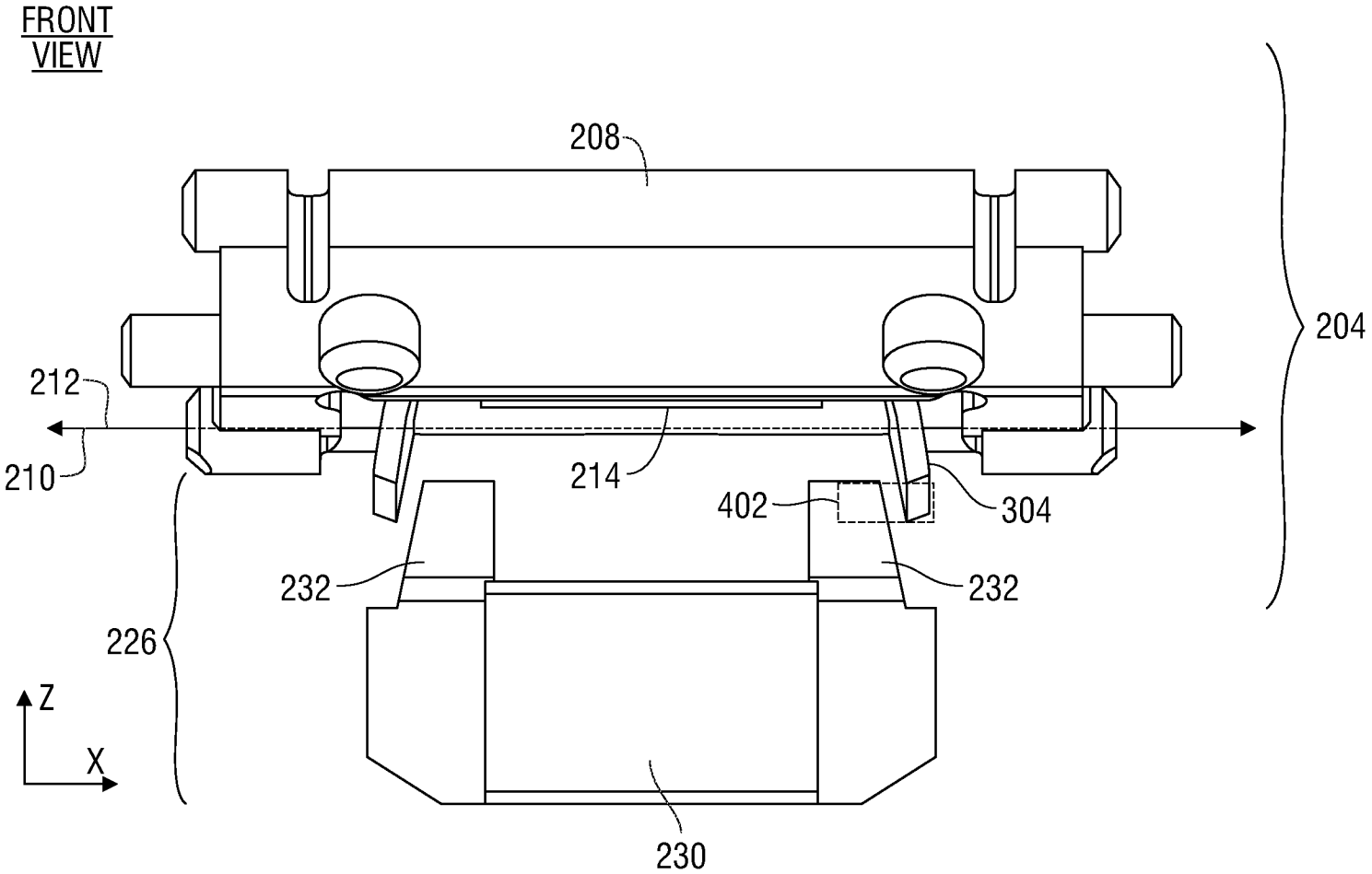
FIG. 4A is a front graphical diagram view of an EPM and a scissor plate assembly in a depressed position according to an embodiment of the present disclosure.

FIG. 4A is a front graphical diagram view of an electropermanent magnet (EPM) and a scissor plate assembly in a depressed position with and a scissor plate flange shaped for increased magnetic attraction between the flange and the EPM according to an embodiment of the present disclosure. As described herein, the key assembly is in a depressed position when downward force is being exerted on the key cap (not shown), causing the front scissor plate 208 and rear scissor plate to rotate about their respective rotation axes 210 and 212 in an embodiment. In the fully depressed position, the rear scissor plate may rotate out of view in the front view. The scissor plate EPM flange 214 in such a depressed state may also rotate when the rear scissor plate to which the flange 214 is fixedly and operably attached rotates. The EPM 226 in such an embodiment may not rotate, however, as it is in a fixed position throughout the functional movement of the key switch assembly.

In an embodiment, when the edge of the rear scissor plate located opposite the rear plate rotation axis 210 moves downward with respect to the rear plate rotation axis 210, as in the depressed position, the edge of the scissor plate EPM flange 214 located furthest from the rear plate rotation axis 210 may move upward and away from the magnetically soft shunts 232 of the fixed position EPM 226, including angled overlap protrusions 304. Thus, as the key switch assembly moves into its depressed position, the distance between all surfaces of the scissor plate EPM flange 214, including angled overlap protrusions 304, move away from the magnetically soft shunts 232 in an embodiment. As this distance increases, the size of the overlapping region 402 also decreases.

The scissor plate EPM flange 214 in an embodiment may be formed of a ferromagnetic material that may be attracted by the combined magnetic field generated by the EPM 226 and propagated by the magnetically soft shunts 232. The EPM 226 may include one or more low-coercivity magnets 230 and one or more high-coercivity magnets (not shown). An EPM keyboard control system in an embodiment may deliver current to an electrically conductive wire coiled around the low-coercivity magnet 230 to generate a magnetic field that combines with the magnetic field generated by the high-coercivity magnet (not shown) to generate a combined magnetic field capable of attracting the scissor plate EPM flange 214 toward the magnetically soft shunts 232. In other aspects, the EPM keyboard control system in an embodiment may deliver a current to an electrically conductive wire coiled around the low-coercivity magnet 230 that causes the magnetic field of the low-coercivity magnet 230 to reverse polarity. This may result in the high-coercivity magnetic field negating the low-coercivity magnetic field, and completely or substantially dissipating the combined magnetic field of the EPM 226, such that the shunts 232 no longer propagate any significant magnetic field. In still other aspects, the EPM keyboard control system may place the EPM 226 in a middle state in which one EPM within a dual-EPM system is placed in an on state and another EPM in the dual system is placed in an off state.

Thus, use of such an EPM 226 in an embodiment may allow the EPM keyboard control system in an embodiment to adjust the magnitude of the combined magnetic field generated by the EPM 226. This allows for the placement of an EPM 226 in each of the key switch assemblies of the keyboard, such that the EPM keyboard control system in an embodiment may dynamically adjust the magnetic fields generated by each EPM on a key by key basis. In some embodiments, an adjustable level EPM may be used allowing adjustment to magnitude of the combined EPM magnetic field.

Figure 4B:
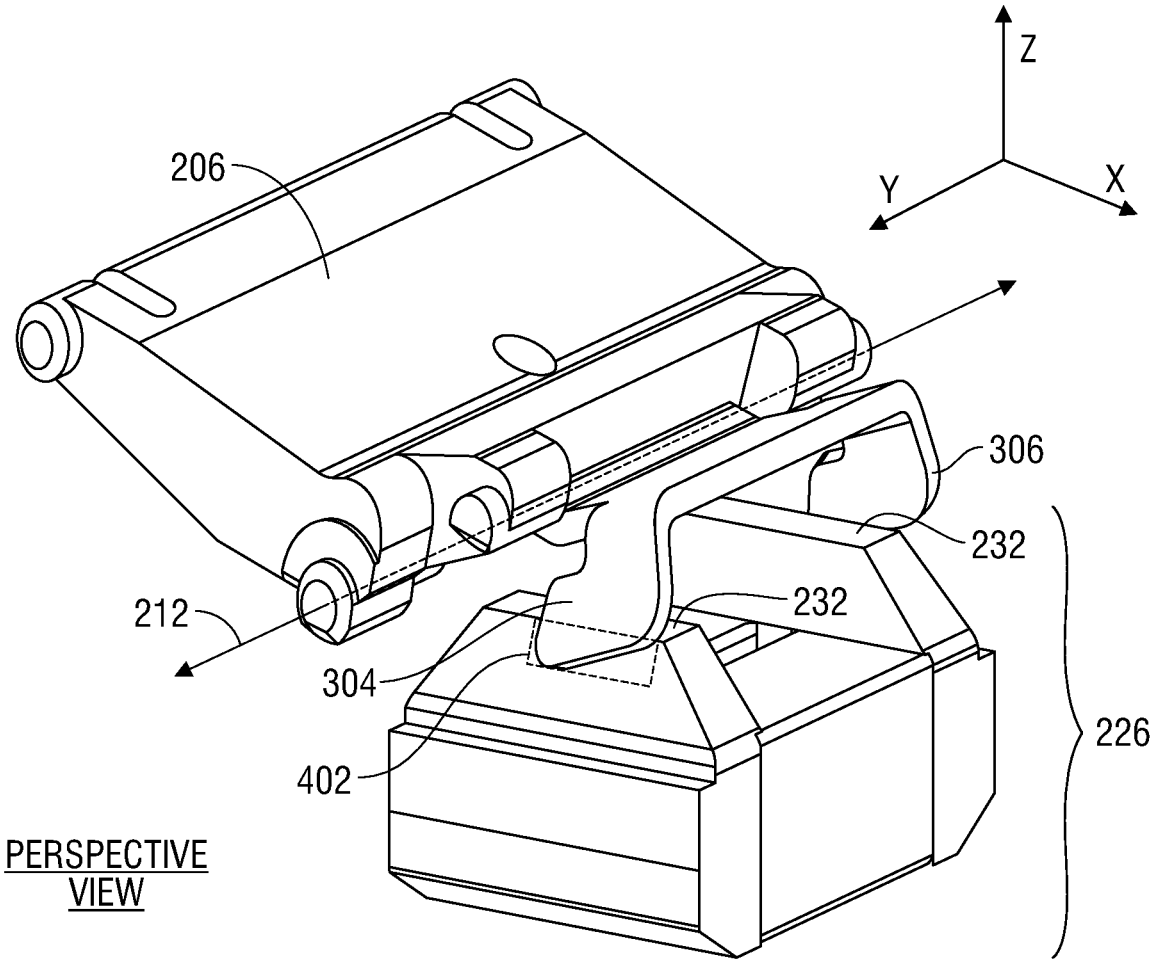
FIG. 4B is a perspective graphical diagram view of an EPM and a scissor plate assembly in a depressed position according to an embodiment of the present disclosure.

FIG. 4B is a perspective graphical diagram view of an electropermanent magnet (EPM) and a scissor plate assembly in a depressed position and a scissor plate flange shaped for increased magnetic attraction between the flange and the EPM according to an embodiment of the present disclosure. The magnetic force exerted on an object (e.g., flange 214) by the magnetic field generated by the EPM 226 and propagated by the magnetically soft shunts 232 in an embodiment may decline as the distance between that object and the magnetically soft shunts 232 increases. Consequently, the magnetic field in an embodiment may not be strong enough to attract the neutrally horizontal flange portion 306 when the flange is in its fully depressed position, due to the increased distance between the magnetically soft shunts 232 and the neutrally horizontal flange portion 306.

However, a portion of each of the angular overlap protrusions 304 in an embodiment may stay within proximity to the magnetically soft shunts 232, and provide a greater overlapping surface area between the flange 214 and the magnetically soft shunts 232 when the key switch assembly is in its fully depressed position. For example, the region 402 represents the area in which a portion of the surface area of one of the angular overlap protrusions 304 remains somewhat within proximity to one of the external surface of the magnetically soft shunts 232. The dimensions of the angular overlap protrusion 304 in an embodiment may be designed to ensure the angular overlap protrusions 304 are in close enough proximity to the magnetically soft shunts 232 when the key switch assembly is in its fully depressed state such that the magnetic field propagated by the magnetically soft shunts 232 in an embodiment is strong enough to attract the flange, and thus restore the rear scissor plate 206 back into its neutral position. For example, 20% of the surface area of each angular overlap protrusion 304 may need to remain in proximity to the magnetically soft shunts 232 in an embodiment in order for the magnetic fields propagated by the magnetically soft shunts 232 to return the scissor plate assembly to its neutral position from its fully depressed position. In such an embodiment, the angular overlap protrusions 304 may have dimensions such that at least 20% of their surface areas protruding angularly below the top surface of the magnetically soft shunts 232 when the scissor plate assembly is in its fully depressed position. This is only one example of a surface area threshold value, and other percentage values are also contemplated.

Figure 5:
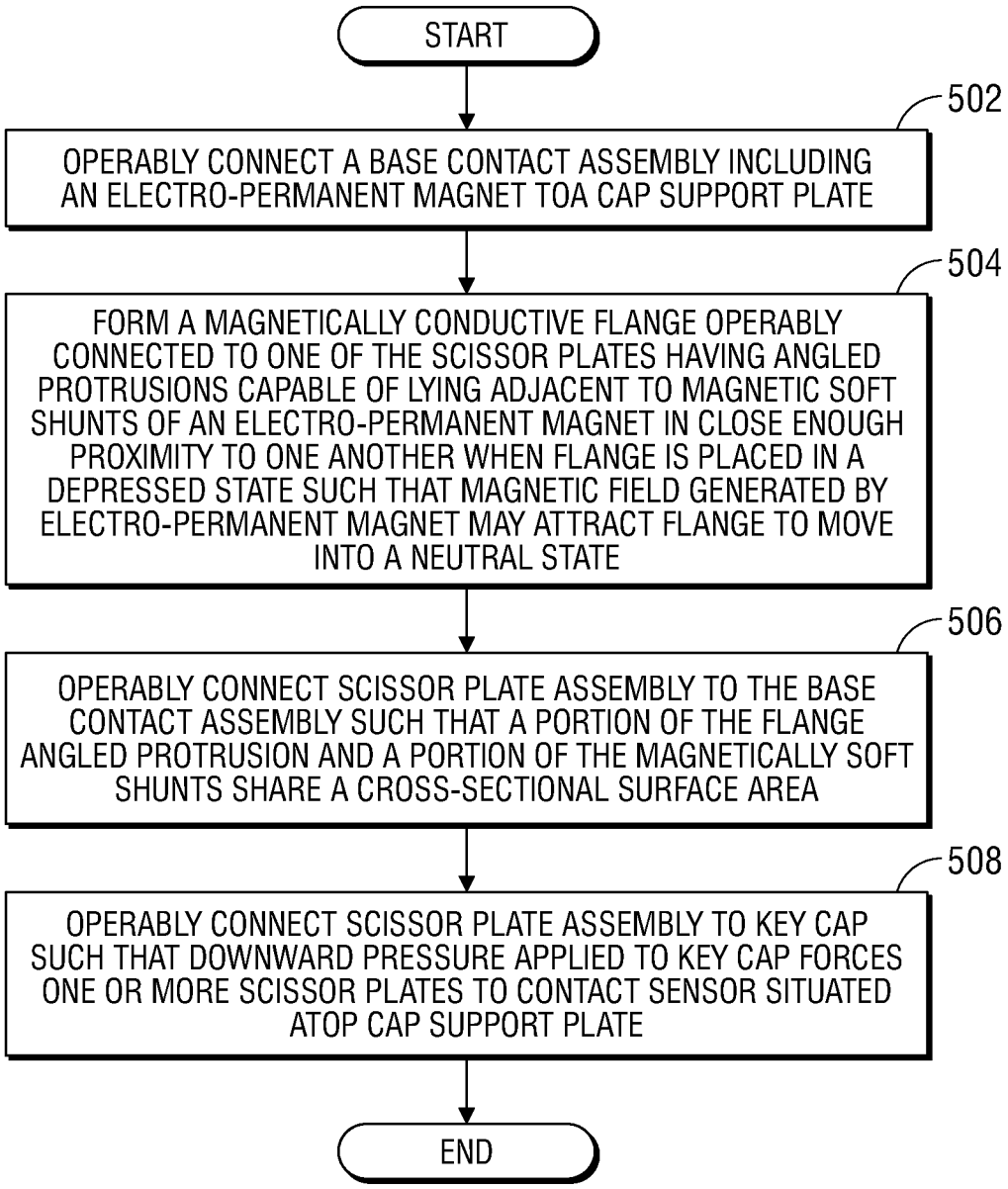
FIG. 5 is a flow diagram illustrating a method of fabricating a key switch assembly with an EPM and a scissor plate flange according to an embodiment of the present disclosure.

FIG. 5 is a flow diagram illustrating a method of assembling a key switch assembly with an electropermanent magnet (EPM) and a scissor plate flange shaped for increased magnetic attraction between the flange and the EPM according to an embodiment of the present disclosure. As described herein, use of EPMs within key switch assemblies in an embodiment may allow for an EPM keyboard control system to dynamically adjust the magnetic fields generated by each EPM on a key by key basis. Such key switch assemblies in an embodiment may enable an information handling system to register a keystroke entered by a user via a keyboard.

At block 502, the base contact assembly in an embodiment may be operably connected to the cap support plate. For example, in an embodiment described with reference to FIG. 2, the base contact assembly 220, which may include the EPM 226, may be operably connected to the cap support plate 222. A portion of the base contact assembly 220 in such an embodiment may be disposed within an opening of the cap support 222, such as a PCB board, prior to such operable connection. For example, the portion of the base contact assembly 220 transected by the rotation axes 210 and 212 in an embodiment may be disposed upward through an opening of the cap support plate 222.

A magnetically conductive flange may be formed and operably connected to one of the scissor plates in an embodiment at block 504. As described herein, the force exerted on a magnetic object (e.g., flange 214) by the combined magnetic field generated by the EPM 226 and propagated by the shunts 232 in an embodiment may decline as the distance between such object and the surfaces of the magnetically soft shunts 232 increases. Consequently, a flange 214 in an embodiment may have angular protrusions situated in close enough proximity to the EPM 226 and magnetically soft shunts 232 (upon full assembly of the key switch assembly 200) such that when the scissor plate assembly 204 is in its fully depressed position, the combined magnetic field generated by the EPM 226 attracts the flange 214, moving the scissor plate assembly 204 back into a neutral state. For example, in an embodiment described with reference to FIG. 4B, a portion of each of the angular overlap protrusions 304 in an embodiment may stay somewhat within proximity to the magnetically soft shunts 232 when the key switch assembly is in its fully depressed position. In an embodiment, 20% of the surface area of each angular overlap protrusion 304 may need to remain somewhat in proximity to the magnetically soft shunts 232 in order for the combined magnetic field of the EPM 226 to return the scissor plate assembly to its neutral position from its fully depressed position, for example. In such an embodiment, the angular overlap protrusions 304 may have dimensions such that at least 20% of their surface areas protrude at an angle below the top surface of the magnetically soft shunts 232 when the scissor plate assembly is in its fully depressed position. This is only one example of a surface area threshold value, and other percentage values are also contemplated.

The flange may be operably connected to one of the scissor plates such that a portion of each of the angular overlap protrusions is substantially adjacent to an exterior surface of the magnetic shunts 232, in both the neutral and depressed positions in an embodiment. For example, in an embodiment described with reference to FIG. 3A, the rear scissor plate 206 may be operably and fixedly attached to the scissor plate EPM flange 214 at the rotating edge of the rear scissor plate 206. In such an embodiment, when the edge of the rear scissor plate 206 located opposite the rear plate rotation axis 210 moves downward with respect to the rear plate rotation axis 210, the edge of the scissor plate EPM flange 214 located furthest from the rear plate rotation axis 210 may move upward. Similarly, when the edge of the rear scissor plate 206 located opposite the rear plate rotation axis 210 moves upward with respect to the rear plate rotation axis 210, the scissor plate EPM flange 214 located furthest from the rear plate rotation axis 210 may move downward.

As another example, in an embodiment described with reference to FIG. 3B, the scissor plate EPM flange 214 may include angular overlap protrusions 304, protruding outward toward the EPM 226 from the neutrally horizontal flange portion 306 oriented roughly horizontally (e.g. within the XY plane) when the scissor plate EPM flange 214 is in its neutral position. For each of the angular overlap protrusions 304 in such an embodiment, almost the entire surface area of the angular overlap protrusion 304 in such an embodiment may be located substantially adjacent to an exterior surface of the magnetic shunts 232. As yet another example, in an embodiment described with reference to FIG. 4B, a portion of each of the angular overlap protrusions 304 in an embodiment may be located substantially adjacent to an exterior surface of the magnetic shunts 232 when the key switch assembly is in its fully depressed position.

At block 506, the scissor plate assembly may be operably connected to the base contact assembly in an embodiment such that a portion of the flange angled protrusions and a portion of the magnetically soft shunts share a cross-sectional surface area. For example, the scissor plates 206 and 208 in an embodiment may be operably connected to the portion of the base contact assembly 220 disposed upward through the opening in the cap support plate 222, such that the rotation axis for each of the scissor plates transects a cross-sectional area shared by the scissor plates 206 and 208 and the base contact assembly 220. In such an embodiment, a pin or similar mechanism may join the scissor plates 206 and 208 to one or more holes within the base contact assembly 220 to form one or more hinges.

In the example embodiment illustrated by FIG. 2, the rear scissor plate 206 may be joined with the base contact assembly 220 in such a way to form a hinge allowing the rear scissor plate 206 to rotate about the rear plate rotation axis 210 that transects a cross-sectional area (e.g., in the YZ plane) shared by both the rear scissor plate 206 and the base contact assembly 220. Similarly, the front scissor plate 208 may be joined with the base contact assembly 220 to allow the front scissor plate 208 to rotate about the front plate rotation axis 212 transecting a cross-sectional area (e.g., in the YZ plane) shared by both the front scissor plate 206 and the base contact assembly 220. In other embodiments, the front scissor plate 208 and rear scissor plate 206 may share a single rotational axis. In still other embodiments, the scissor plate assembly 204 may include only one scissor plate, having a single rotational axis.

The scissor plate assembly may be operably connected to the base contact assembly such that a portion of each of the angular overlap protrusions of the scissor plate flange is substantially adjacent to an exterior surface of a magnetically soft shunt of the EPM, in both the neutral and depressed positions in an embodiment. For example, in an embodiment described with reference to FIG. 3A, the rear scissor plate 206 may be operably and fixedly attached to the scissor plate EPM flange 214 at the rotating edge of the rear scissor plate 206. In such an embodiment, when the edge of the rear scissor plate 206 located opposite the rear plate rotation axis 210 moves downward with respect to the rear plate rotation axis 210, the edge of the scissor plate EPM flange 214 located furthest from the rear plate rotation axis 210 may move upward. Similarly, when the edge of the rear scissor plate 206 located opposite the rear plate rotation axis 210 moves upward with respect to the rear plate rotation axis 210, the scissor plate EPM flange 214 located furthest from the rear plate rotation axis 210 may move downward.

As another example, in an embodiment described with reference to FIG. 3B, the scissor plate EPM flange 214 may include angular overlap protrusions 304, protruding outward toward the EPM 226 from the neutrally horizontal flange portion 306 oriented roughly horizontally (e.g. within the XY plane) when the scissor plate EPM flange 214 is in its neutral position. For each of the angular overlap protrusions 304 in such an embodiment, almost the entire surface area of the angular overlap protrusion 304 in such an embodiment may be located substantially adjacent to an exterior surface of the magnetically soft shunts 232. As yet another example, in an embodiment described with reference to FIG. 4B, a portion of each of the angular overlap protrusions 304 in an embodiment may be located substantially adjacent to an exterior surface of the magnetically soft shunts 232 when the key switch assembly is in its fully depressed position.

The scissor plate assembly in an embodiment may be operably connected to a key cap such that pressure applied to the key cap forces one or more scissor plates within the scissor plate assembly to rotate about one or more rotation axes at block 508. For example, in an embodiment described with reference to FIG. 2, each key in a keyboard may be incorporated within a key switch assembly 200, and may comprise a key cap 202 lying atop a scissor plate assembly 204. The scissor plate assembly 204 in an embodiment may include a rear scissor plate 206 and a front scissor plate 208. As a downward force is exerted on the key cap 202, the top portions (e.g. portions located furthest from the rotation axes 210 and 212) of the rear scissor plate 206 and front scissor plate 208 may move away from one another in the Y-direction. In one embodiment, the rear scissor plate 206 may rotate around a rear scissor plate rotation axis 210, and the front scissor plate 208 may rotate around a front scissor plate rotation axis 212. In other embodiments, both scissor plates 206 and 208 may operate about a single rotation axis. In still other embodiments, only one scissor plate may be employed, and it may rotate about a single rotation axis.

In an embodiment, a keystroke described herein may be registered upon detected contact between one of the scissor plates 206 or 208 and a sensor. Such a sensor may be situated, in one example, on the top surface of the cap support plate 222, such that the bottom portion of one or both of the scissor plates 206 or 208 comes into contact with the sensor when the key cap 202 reaches its lowest allowable vertical position. The sensor may be, for example, a pressure sensor sensing the downward pressure from the scissor plate(s) 206 or 208, or in another example, an electrical contact that completes a circuit when it comes into contact with a corresponding metal contact located on the bottom portion of the one or more scissor plates 206 and 208. For example, the sensor may be a pressure sensor located on the top surface of the cap support plate, directly beneath one or more of the scissor plates 206 and 208. In such a way, a key switch assembly 200 in an embodiment may enable an information handling system to register a keystroke entered by a user via a keyboard. The cap support plate may be a printed circuit board such that the sensor may report the keystroke back to a keyboard controller in some example embodiments.

Figure 6:
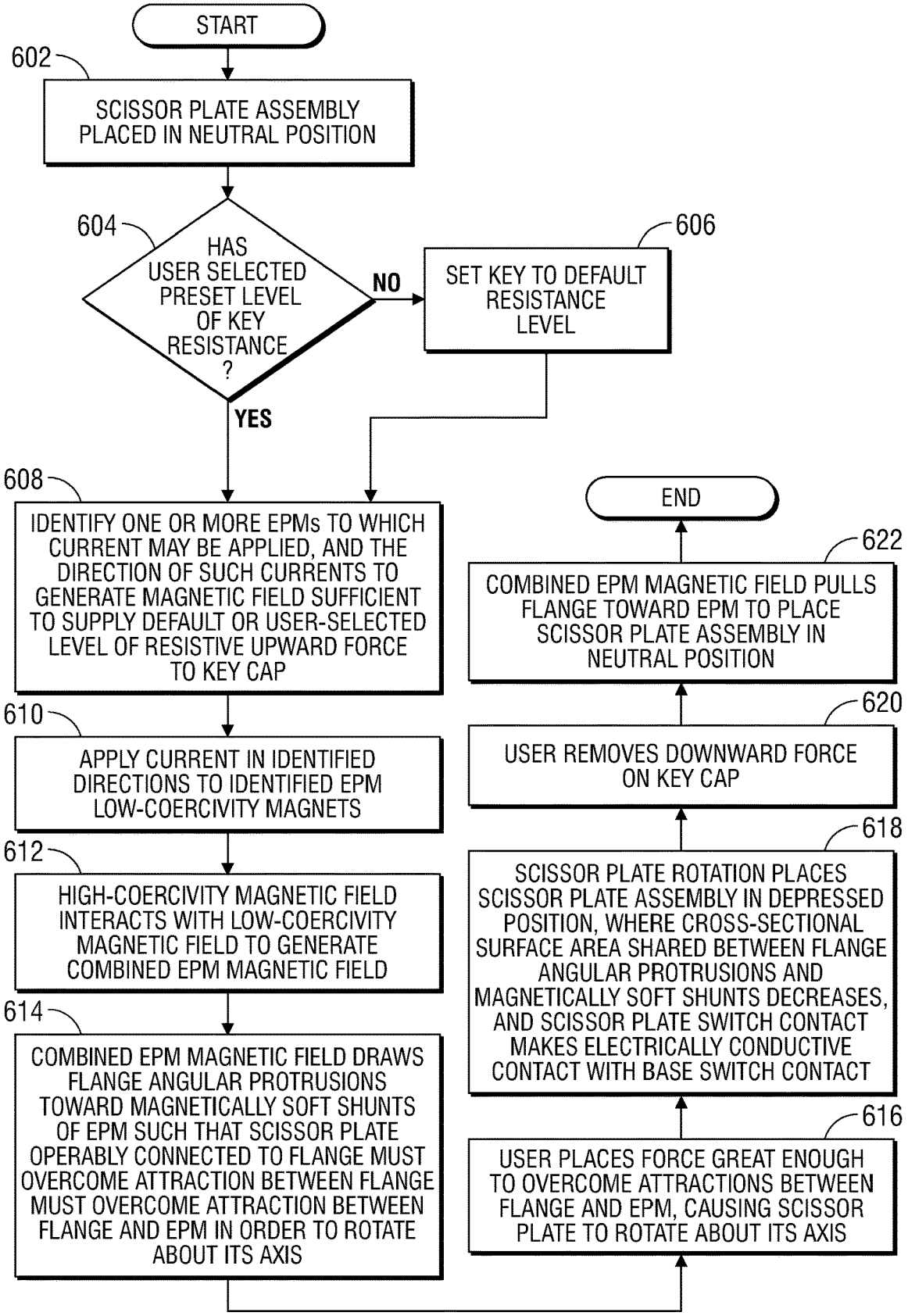
FIG. 6 is a flow diagram illustrating a method of adjusting the downward force needed to depress a key according to an embodiment of the present disclosure.

FIG. 6 is a flow diagram illustrating a method of adjusting the downward force needed to depress a key within a key switch assembly by controlling a degree of magnetic attraction between a scissor plate flange and an EPM according to an embodiment of the present disclosure. As described herein, the EPM key assembly in embodiments of the present disclosure may provide an upward force to return each key cap to its neutral position, as well as a user-specified resistive force that may be adjusted on a key by key basis, without disrupting operation of any nearby internal components. FIG. 6 describes a method of controlling the upward force applied to the key cap by the EPM in an embodiment.

At block 602, the scissor plate assembly in an embodiment may be placed in a neutral position. For example, in an embodiment described with reference to FIG. 3A, the key assembly is in a neutral state when no downward force is being exerted on the key cap. In such a state, neither the front scissor plate 208 nor the rear scissor plate 206 may be rotated about their respective axes 210 and 212 in an embodiment. Further, in an embodiment described with reference to FIG. 3B, the neutrally horizontal flange portion 306 may be oriented substantially horizontally (within the XY plane) when the scissor plate assembly is placed in the neutral position. Also, in an embodiment described with reference to FIG. 2, the top surface of the key cap 202 may be lying flush with adjacent key caps within the keyboard, and the scissor plate contact 218 and base contact 224 may not be in contact with one another while the scissor plate assembly 204 is in its neutral state.

The EPM keyboard control system in an embodiment may determine at block 604 whether the user has selected a preset level of key resistance. As described herein, the upward force supplied to the key cap by the EPM may be adjustable. In some embodiments, such an adjustment may be made based on user input. For example, each individual user may provide user input via a user interface to set the force required to press keys on the keyboard to a level that is tactilely pleasing to the user. If the user has not selected a preset level of key resistance, the method may proceed to block 606. If the user has selected a preset level of key resistance, the method may proceed to block 608.

At block 606, the EPM keyboard control system in an embodiment may set the key switch assembly to a default resistance level. Such a default resistance level may be static and preset (e.g., at the factory), or may be set according to one or more detected external stimuli. In other embodiments, the information handling system may detect (e.g., via rotation sensors, hall sensors, proximity sensing elements, gyroscopes, etc.) that the information handling system has been placed in a closed or tablet configuration in which the keyboard is not likely to be used. In such an embodiment, the EPM keyboard control system may set the key switch assembly to stay in a depressed position by turning off the EPM as a default, such that the keys cannot be actuated. In such a way, the EPM keyboard control system may avoid erroneous keystrokes occurring during tablet mode, for example. In yet another embodiment, the EPM keyboard control system may set the key switch assembly upward force based on input received from other applications running on the information handling system to set a default resistance level on the keyboard as a whole or on a key-by-key basis. For example, the EPM keyboard control system may receive an indication from a concurrently executed third-person shooter computer game to set the key switch assembly for a given key in a fixed depressed position if actuation of the given key represents an action currently unavailable to the user (e.g., firing of an unavailable weapon).

The EPM keyboard control system in an embodiment may identify one or more EPMs to which current may be applied, and the direction in which such currents may be applied to generate a combined EPM magnetic field sufficient to supply the default or user-selected level of resistive upward force to the key cap at block 608. In an embodiment described with reference to FIG. 3A, EPM 226 may generate a combined magnetic field that attracts the flange 214 downward. The user must apply a downward force on the key cap 202 sufficient to overcome this magnetic attraction between the flange 214 and the EPM 226, such that the rear scissor plate 206 may rotate about its axis 210, pulling the flange 214 upward and away from the EPM 226. The magnetic attraction between the flange 214 and the EPM 226 in such an embodiment may depend upon the magnitude of the magnetic field generated by the EPM 226. As described herein, in an embodiment employing a single level EPM having a balanced number of high-coercivity magnets and low-coercivity magnets, the single level EPM may be capable of operating in two states. First, the single EPM may be capable of operating in an on state in which the high-coercivity magnetic field combines with the low-coercivity magnetic field. Second, the single level EPM may be capable of operating in an off state in which the high-coercivity magnetic field negates the low-coercivity magnetic field. The EPM keyboard control system in an embodiment may place such a single level EPM in one of these two states based on the direction of a current it applies to one or more electrically conductive wires coiled around the low-coercivity magnet or magnets of the single level EPM.

In other aspects, in an embodiment employing a plurality of EPMs within an EPM system, the magnetic fields of each of the plurality of EPMs may be combined in various ways to add or negate magnetic fields to provide various levels of magnetic force in a combined EPM magnetic field. Such a multi-level magnetic field may have varying strengths, based on the states in which each of the plurality of EPMs are placed. For example, the EPM keyboard control system in an embodiment may cause the EPM system to generate a low combined EPM magnetic field by enabling fewer of the plurality of EPMs combinations, or to generate a high combined EPM magnetic field by placing more of the plurality of EPMs in a combined on state. As an example, the EPM keyboard control system in an embodiment may cause the EPM system to generate one or more mid-level magnetic fields by placing various combinations of the plurality of EPMs in an on state and placing others in an off state. The EPM keyboard control system in embodiment may be capable of accessing stored tables in memory that correlate a plurality of combinations of EPMs and current directions with a plurality of resistive upward force values. Such a table may be generated during manufacture of the key switch assembly 200 through testing.

At block 610, the EPM keyboard control system in an embodiment may apply current in the identified direction or directions to the electrically conductive wire coiled around the low-coercivity magnets of the identified EPMs. The low-coercivity magnets 230 alone or in array with other high-coercivity magnets in such an embodiment may then generate a magnetic field that either combines with or negates the magnetic fields generated by a high-coercivity magnet or magnets of the identified EPM.

The magnetic field generated by the high-coercivity magnet may interact with the magnetic field generated by the low-coercivity magnet of the identified EPM(s) to generate a combined EPM magnetic field that is a default or user-selectable magnetic field at block 612. For example, in an embodiment including an EPM system 226 described with reference to FIG. 2, a plurality of the low-coercivity magnets 230 may be situated nearby one of the high-coercivity magnets 228. If one of the high-coercivity magnets 228 generates a magnetic field having the opposite polarity as the magnetic field generated by the low-coercivity magnet 230 situated nearby, the high-coercivity magnetic field may negate the low-coercivity magnetic field to completely or partially dissipate the combined EPM magnetic field. In contrast, if one of the high-coercivity magnets 228 generates a magnetic field having the same polarity as the magnetic field generated by the low-coercivity magnet 230 situated nearby, the high-coercivity magnetic field may combine with the low-coercivity magnetic field to generate a combined EPM magnetic field of a magnitude greater than either the high-coercivity magnetic field or the low-coercivity magnetic field. This will be an on state in some embodiments.

At block 614, the combined EPM magnetic field in an embodiment may draw an angular overlap protrusion toward one or more magnetically soft shunts 232 propagating the combined magnetic field of the EPM 226, such that the scissor plates tend to rotate toward one another. For example, in an embodiment described with reference to FIG. 3A, as the scissor plate EPM flange 214 is drawn downward toward the magnetically soft shunts 232, the rear scissor plate 206 experiences a rotational force causing the portion of the rear scissor plate 206 located farthest from the rear plate rotation axis 210 to tend toward the front scissor plate 208.

The user may apply a force great enough to overcome the attraction between the flange and the EPM in an embodiment at block 616. As described herein, the key cap moves downward by rotating the portions of the scissor plates located farthest from their respective rotational axes away from one another. Thus, in order to depress the key cap lying atop the scissor plate assembly in an embodiment, the user must supply a force great enough to overcome the rotation force causing the portion of the rear scissor plate 206 located farthest from the rear plate rotation axis 210 to tend toward the front scissor plate 208. This rotational force may be dependent upon the magnetic attraction between the flange 214 and the EPM 226 in an embodiment. Upon application of such a force, the key cap 202 may move downward, and the scissor plate assembly 204 may be placed in its depressed position in which the portion of surface area of the angular overlap protrusion that is subject to the EPM magnetic field (e.g., adjacent and somewhat in proximity to the low-coercivity magnets) may decrease.

At block 618, a scissor plate switch contact may make electrically conductive contact with a base switch contact.

For example, in an embodiment described with reference to FIG. 2, a portion of the scissor plates 206 and 208 or keycap 202, or a structure extending from or operably attached to the scissor plates 206 and 208 or keycap 202 may initiate contact with a sensor within the base contact assembly 220. In one example embodiment, a scissor plate switch contact 218 in such an embodiment may be operably connected to a rocker arm 216 extending from and operably connected to the cap support plate 222. Upon final construction of the whole key switch assembly 200 in an embodiment, the rocker arm 216 may extend outward in the Y-direction to engage the scissor plate switch contact 218 leaf spring that is located slightly further forward in the Y-direction than (but at the same vertical height as) the base switch contacts 224 when the key cap 202 is in its neutral position. While in the neutral position, the magnetic field of the EPM 226 may pull the scissor plate EPM flange 214 downward toward the EPM 226, causing the bottom surface of the flange 214 to come into contact with the top surface of the portion of the rocker arm 216 closest to the flange 214. This contact may cause the rocker arm 216 to rotate about its hinge, such that the scissor plate switch contact 218 is extended forward in the Y-direction, away from the base switch contact 224.

When the key cap 202 is forced down to its depressed position in such an embodiment, the rotation of the upper portions of scissor plates 206 and 208 away from one another (in the Y-direction) may cause the scissor plate EPM flange 214 to rotate upward such that it no longer contacts the rocker arm 216, allowing the rocker arm to rotate such that the scissor plate switch contact 218 leaf spring relaxes and the ends of the scissor switch plate contact 218 contact the base switch contacts 224. This contact may close a circuit, which the information handling system in an embodiment may register as a key stroke.

In other contemplated embodiments, a keystroke may be registered upon detected contact between one of the scissor plates 206 or 208 or keycap 202 and a switch sensor. Such a sensor may be situated, in one example, on the top surface of the cap support plate 222, such that the bottom portion of one or both of the scissor plates 206 or 208 or keycap 202 comes into contact with the sensor when the key cap 202 reaches its lowest allowable vertical position. The sensor may be, for example, a pressure sensor sensing the downward pressure from the scissor plate(s) 206 or 208, or in another example, an electrical contact that completes a circuit when it comes into contact with a corresponding metal contact located on the bottom portion of the one or more scissor plates 206 and 208. In another embodiment, a portion of keycap 202 may come into contact with a pressure sensor switch to record a keystroke. In yet other embodiments, downward actuation of the keycap 202 may engage a portion or extension of the keycap 202 with a switch sensor.

The user may remove the downward force on the key cap at block 620 in an embodiment, causing the combined EPM magnetic field to pull the flange toward the EPM and place the scissor plate assembly in the neutral position. For example, in an embodiment described with reference to FIG. 4B, a portion of each of the angular overlap protrusions 304 in an embodiment may stay somewhat within proximity to the magnetically soft shunt 232 when the key switch assembly is in its fully depressed position. The dimensions of the angular overlap protrusion 304 in an embodiment may be designed to ensure the angular overlap protrusions 304 are in somewhat closer proximity to the magnetically soft shunt 232 when the key switch assembly is in its fully depressed state as compared to a flange not having angular overlap protrusions 304. The angular overlap protrusions 304 improve operation of the key assembly such that the combined EPM magnetic field in an embodiment is strong enough to better attract the flange downward toward the magnetically soft shunt 232. Such downward movement of the flange 214 toward the magnetically soft shunt 232 in an embodiment may then more effectively cause the portions of the front and rear scissor plates 206 and 208 located farthest from the rotation axes 210 and 212 to move toward one another. The key cap 202 may then be pushed upward by the scissor plates 206 and 208, to better ensure return to its neutral position, where its top surface is flush with nearby keys in the keyboard.

The blocks of the flow diagrams of FIGS. 5-6 or steps and aspects of the operation of the embodiments herein and discussed above need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents and shall not be restricted or limited by the foregoing detailed description.

What is claimed is:

1. An electro-permanent magnet key assembly of an information handling system comprising:

an electro-permanent magnet (EPM) having a low-coercivity magnet and a high-coercivity magnet, wherein a magnetic field is generated by the EPM depending on a direction of current pulse applied to an electrically conductive wire coiled around the low-coercivity magnet;

a pair of scissor plates operably connected to the EPM such that each of the pair of scissor plates may rotate away from one another in the presence of downward force on the pair of scissor plates;

a key cap situated atop the pair of scissor plates such that downward force on the key cap causes the scissor plates to rotate away from one another, wherein a top surface of the key cap may lie flush with remaining keys of a keyboard when the key cap is in a neutral position; and a flange comprised of ferromagnetic material operably connected to one of the scissor plates having one or more angular overlap protrusions situated adjacent to a portion of the EPM, such that the one or more protrusions are attracted by the magnetic field of the EPM to return the key cap to the neutral position.

2. The electro-permanent magnet key assembly of claim 1 further comprising:

the electropermanent magnet key assembly operably connected to a processor executing code instructions of an electropermanent magnetic keyboard control system to:

receive an indicator of selected magnetic field magnitude associated in memory with a preset direction of current;

apply the current pulse in the preset direction to the electrically conductive wire coiled around the low-coercivity magnet to generate a combined EPM magnetic force in a multi-level EPM corresponding to the selected magnetic field magnitude.

3. The electro-permanent magnet key assembly of claim 1 further comprising a depression sensor operably connected to the electro-permanent magnet key assembly transmitting an indicator to an operably connected processor that the key cap has been depressed when the scissor plates are rotated away from one another to a maximum allowable angle.

4. The electro-permanent magnet key assembly of claim 1, wherein a multi-level EPM is used and a magnitude of the magnetic field is adjusted by changing the direction of the applied current to one or more low-coercivity magnets in an array of high-coercivity magnets and low-coercivity magnets.

5. The electro-permanent magnet key assembly of claim 1, wherein turning off the EPM causes the key cap to drop to a depressed position.

6. The electro-permanent magnet key assembly of claim 1, wherein the high-coercivity magnet is comprised of neodymium.

7. The electro-permanent magnet key assembly of claim 1, wherein the low-coercivity magnet is comprised of aluminum, nickel and cobalt.

8. A method of controlling an electro-permanent magnet key assembly of an information handling system comprising:

applying a first pulse of current in a preset direction of current to an electrically conductive wire coiled around a low-coercivity magnet of an electro-permanent magnet (EPM), such that a magnetic field generated by the low-coercivity magnet combines with a magnetic field generated by a high-coercivity magnet of the EPM to generate a combined EPM magnetic field for an on state of the EPM; and the combined EPM magnetic field pulling a flange comprised of ferromagnetic material having one or more angular overlap protrusions situated adjacent to a portion of the EPM, such that the one or more protrusions are attracted by the magnetic field of the EPM and operably connected to one of a pair of scissor plates toward the EPM, such that the pair of scissor plates moves from a depressed position in which the pair of scissor plates are rotated away from another by a maximum allowable angle, to a neutral position in which the top surface of a key cap situated atop the pair of scissor plates lies flush with other keys of a keyboard surface.

9. The method of claim 8 further comprising:

applying a second pulse of current in a direction opposite of the preset direction to turn off the EPM and to cause the key cap to drop to a depressed position and retract the electro-permanent magnet key assembly.

10. The method of claim 8 further comprising:

receiving an instruction to disable the EPM key assembly;

applying a second pulse of current in a direction opposite the preset direction to the electrically conductive wire; and reversing the polarity of the magnetic field generated by the low-coercivity magnet to negate the magnetic field generated by the high-coercivity magnet, such that the key cap does not return to the neutral position.

11. The method of claim 10, wherein the instruction to disable the electropermanent magnet key assembly is received in response to detection of a rotation position of the electro-permanent magnet key assembly with respect to a digital display of the information handling system indicating an orientation of the information handling system where a keyboard is not used.

12. The method of claim 8, further comprising:

applying the current in the preset direction to the electrically conductive wire while the key cap is in the neutral position, such that the key cap reaches the depressed position when a downward force equal to or greater than an attractive force generated by the combined EPM magnetic field is supplied to the key cap via the scissor plates.

13. The method of claim 8, wherein the low-coercivity magnet is comprised of aluminum, nickel and cobalt.

14. The method of claim 8, wherein the high-coercivity magnet is comprised of neodymium.

15. An electro-permanent magnet key assembly of an information handling system keyboard comprising:

an electro-permanent magnet (EPM) having a low-coercivity magnet and a high-coercivity magnet, wherein a magnetic field is generated by the EPM when a direction of current pulse applied to an electrically conductive wire coiled around the low-coercivity magnet;

a pair of scissor plates operably connected to the EPM such that each of the pair of scissor plates may rotate away from one another in the presence of downward force on the pair of scissor plates;

a key cap operably coupled atop the pair of scissor plates such that downward force on the key cap causes the scissor plates to rotate away from one another, wherein a top surface of the key cap may lie flush with remaining keys of a keyboard when the key cap is in a neutral position;

a flange comprised of ferromagnetic material operably connected to one of the scissor plates having one or more angular overlap protrusions situated adjacent to a side portion of the EPM, such that the one or more angular overlap protrusions are attracted by the magnetic field of the EPM to return the key cap to the neutral position; and a sensor operably connected to the electro-permanent magnet key assembly transmitting an indicator to an operably connected processor that the key cap has been depressed when the scissor plates are rotated away from one another.

16. The electro-permanent magnet key assembly of claim 15, wherein the sensor comprises a base switch contact that comes into contact with the electro-permanent magnet key assembly when the scissor plates are rotated away from one another.

17. The electro-permanent magnet key assembly of claim 15, wherein the sensor comprises a pressure sensor that detects contact between a bottom surface of a keycap or scissor plate and the pressure sensor.

18. The electro-permanent magnet key assembly of claim 15 further comprising:

the electropermanent magnet key assembly operably connected to a processor executing code instructions of an electropermanent magnetic keyboard control system to:

receive an indicator to selectively deactivate at least one EPM of at least one electro-permanent magnet key assembly of a plurality of electro-permanent magnet key assemblies to retract the at least one electro-permanent magnet key.

19. The electro-permanent magnet key assembly of claim 1, wherein a magnitude of the magnetic field is adjusted in an EPM that is a multi-level EPM based on a plurality of currents supplied to a combination of low-coercivity magnets in the multi-level EPM.

20. The electro-permanent magnet key assembly of claim 1, wherein the angled overlap protrusions extend down along a side of the EPM when the electro-permanent magnet key assembly is in a neutral state.

* * * * *